US005246227A

United States Patent [19]

Sun et al.

[11] Patent Number: 5,246,227

[45] Date of Patent: Sep. 21, 1993

[54] GOLF PUTTER WITH SHELL MOLDED ABOUT WEIGHT DISTRIBUTED CORE

[76] Inventors: Donald J. C. Sun, 4251 Ocean Valley La., San Diego, Calif. 93130; Kent M. Anderson, 2613 S. Judy Ave., Sioux Falls, S. Dak. 57103

[21] Appl. No.: 959,348

[22] Filed: Oct. 13, 1992

[51] Int. Cl.[5] ..... A63B 53/04

[52] U.S. Cl. ..... 273/78; 273/171; 273/173; 273/DIG. 1

[58] Field of Search ..... 273/167 R–177 A, 273/187.4, 186.2, 77 R, DIG. 23, 129 K, 164.1, 162 R, DIG. 1

[56] References Cited

U.S. PATENT DOCUMENTS

| | | | |
|---|---|---|---|
| 3,211,455 | 10/1965 | Hyden | 273/173 X |
| 3,212,783 | 10/1965 | Bradley et al. | 273/173 X |
| 3,815,910 | 6/1974 | Raines | 273/167 R X |
| 3,843,122 | 10/1974 | Florian | 273/167 R X |
| 4,113,249 | 9/1978 | Beery | 273/78 |
| 4,121,832 | 10/1978 | Ebbing | 273/173 X |
| 4,508,350 | 4/1985 | Duelos | 273/169 X |
| 4,591,160 | 5/1986 | Piragino | 273/167 R |
| 4,762,324 | 8/1988 | Anderson | 273/171 |
| 4,898,387 | 2/1990 | Finney | 273/173 X |

FOREIGN PATENT DOCUMENTS

| | | | |
|---|---|---|---|
| 84/03447 | 9/1984 | World Int. Prop. O. | 273/171 |

*Primary Examiner*—V. Millin
*Assistant Examiner*—Sebastiano Passaniti
*Attorney, Agent, or Firm*—William W. Haefliger

[57] ABSTRACT

A golf putter head having a toe and heel and a ball striking face comprising a metallic core generally in the shape of the head but contained within the head, the core having toe and heel portions; weight structure located within the core proximate the toe and heel portions; and a relatively thin, non-metallic shell molded about the core and the weight structure.

13 Claims, 3 Drawing Sheets

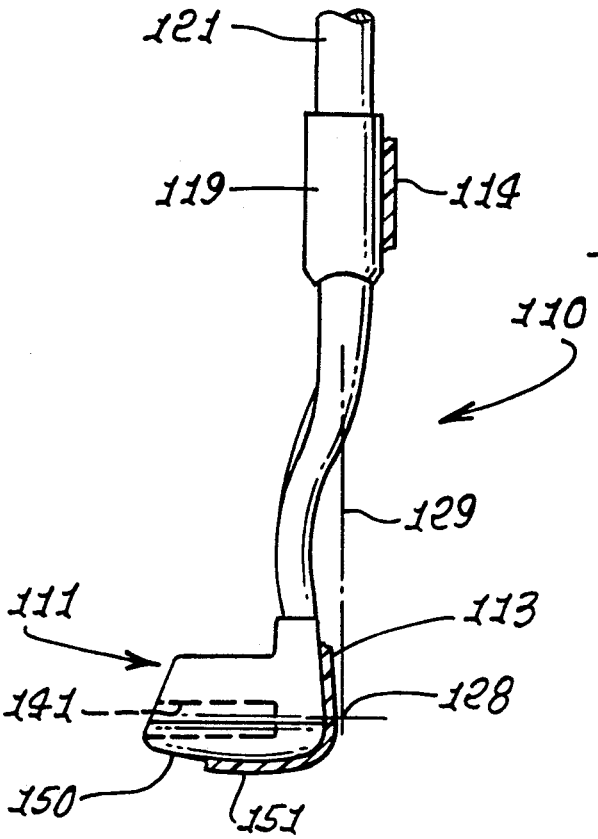
FIG. 5.
FIG. 6.
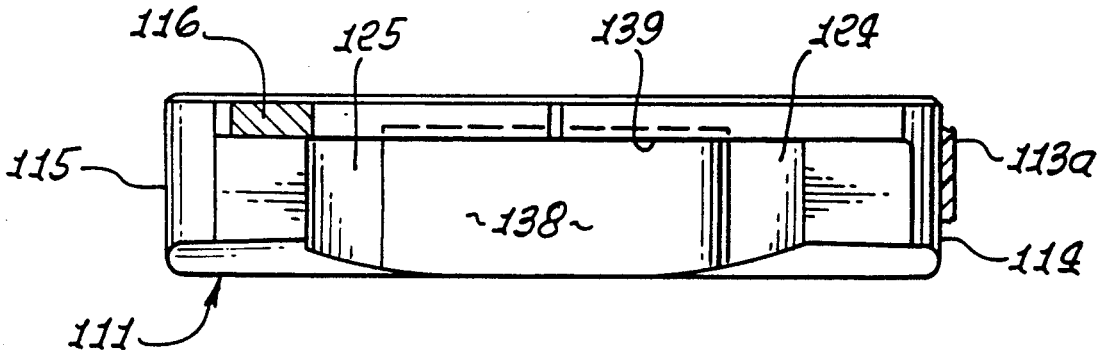
FIG. 7.
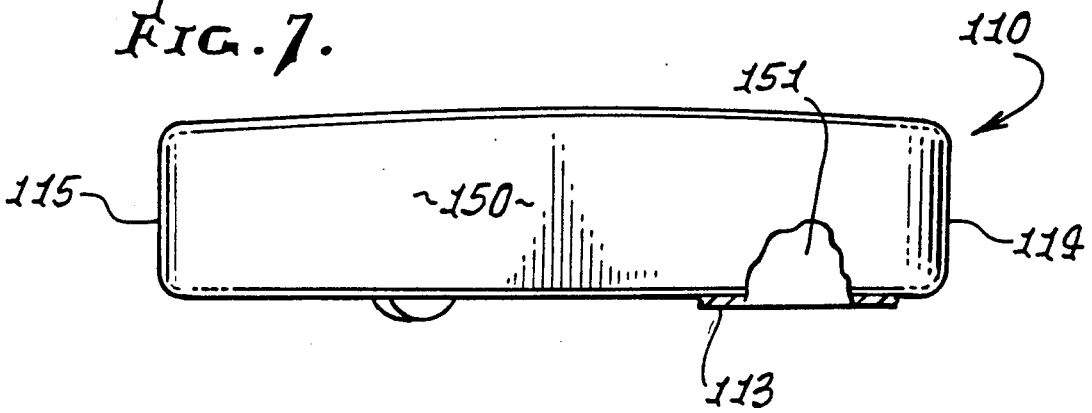

GOLF PUTTER WITH SHELL MOLDED ABOUT WEIGHT DISTRIBUTED CORE

BACKGROUND OF THE INVENTION

This invention relates generally to golf clubs, and more particularly, to the construction of a putter having properties relating to improved static and dynamic balance, twist resistance and greater accuracy for more direct control during putting.

There is continuing need for putters having properties, as referred to, as well as additional improvements in construction and appearance, as will appear.

SUMMARY OF THE INVENTION

It is a major object of the invention to provide an improved putter construction embodying properties as referred to above. Basically, the putter metallic body, and metallic weight inserts forming a core, are embedded within a thin, non-metallic shell, as will appear, for protectively enclosing the body and the inserts; the shell desirably, but not necessarily, also embedding the putter hosel core.

It is another object to provide weight inserts received in core toe and heel recesses, and concealed by the non-metallic shell, which may also cover the forward facing extent of the core, that shell portion thereby also defining the ball-engaging, front face of the putter. In this regard, the golfer sees only the shell, which extends with continuity about the head, and also preferably about the hosel core, whereby he is not distracted by head construction features, such as discontinuities, during putting of a ball on a green.

As will appear, the shell may consist of bulk molding compound or ABS plastic material; or the latter having smaller pieces of filler distributed therein, as for example carbon fibers, 5 mm to 6 mm in length, polycarbonate pieces, and polyproplyene sebacate pieces. In this regard, the core may consist of aluminum or aluminum alloy, and the inserts may consist of lead, or brass, or tungsten, or alloys of same. The shell thickness typically lies within the range 1.0 and 2.0 mm, whereby it does not contribute materially to the weight of the putter or weight distribution, as established by the core and weights.

Yet another object is to provide a putter, as referred to, having means for insert weight adjustment by the golfer as he may deem fit for best putting results. Such means may, for example, comprise a weight holder on the putter and presenting openings for selective weight insertion in a forward direction, as will appear.

These and other objects and advantages of the invention, as well as the details of an illustrative embodiment, will be more fully understood from the following specification and drawings, in which:

DRAWING DESCRIPTION

FIG. 5 is an elevation taken on lines 5—5 of FIG. 4;

FIG. 6 is a top plan view taken on lines 6—6 of FIG. 4; and

FIG. 7 is a bottom plan view taken on lines 7—7 of FIG. 4.

DETAILED DESCRIPTION

Figure 1:
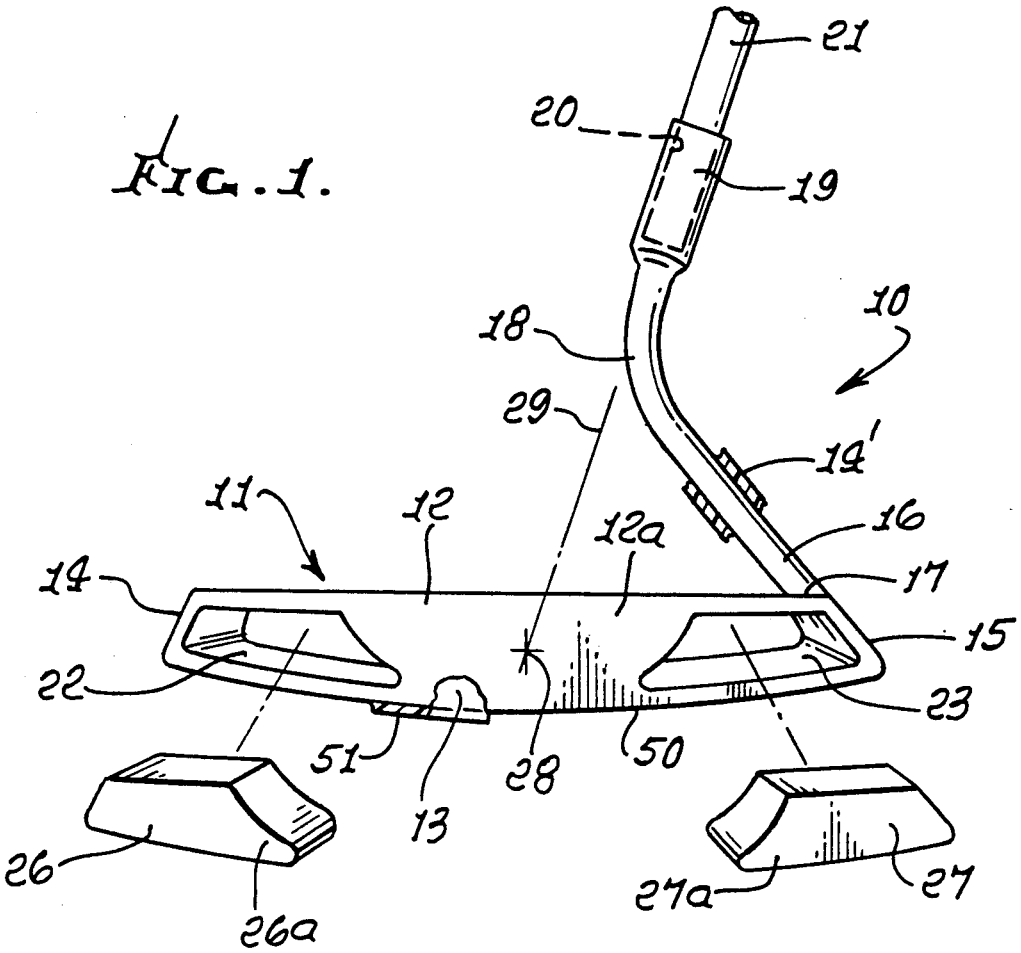
FIG. 1 is an elevation showing the forward side of a golf putter head core, with head and toe area recesses to receive weights.
Figure 2:
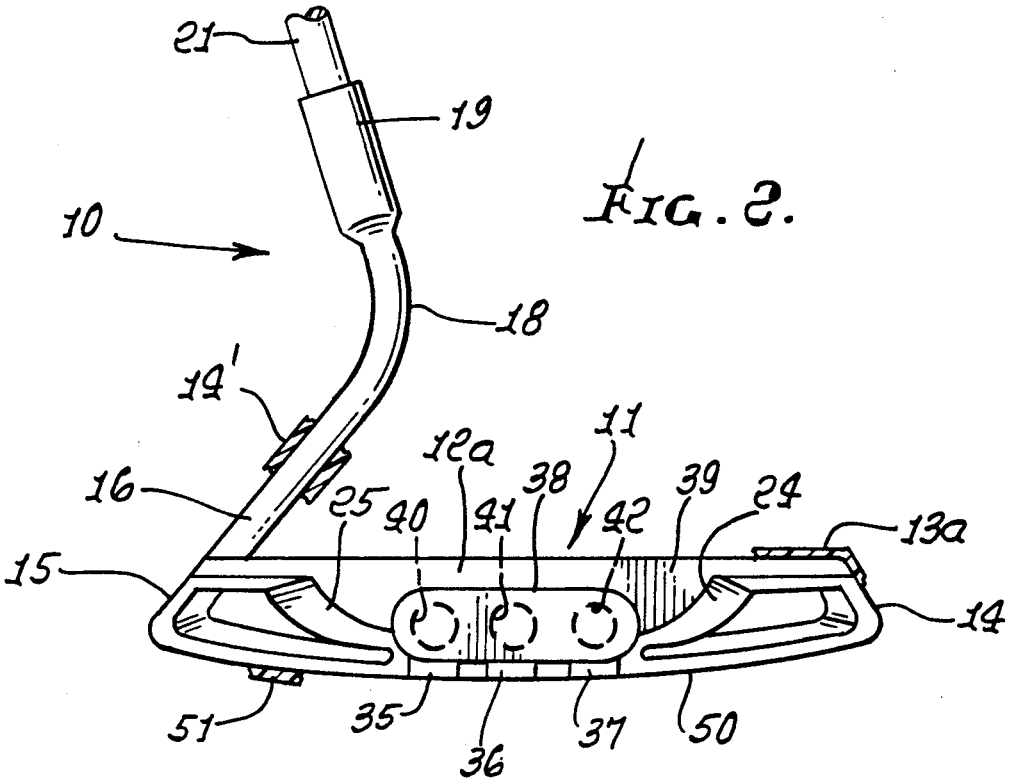
FIG. 2 is an elevation showing the rear side of the FIG. 1 head and hosel.
Figure 3:
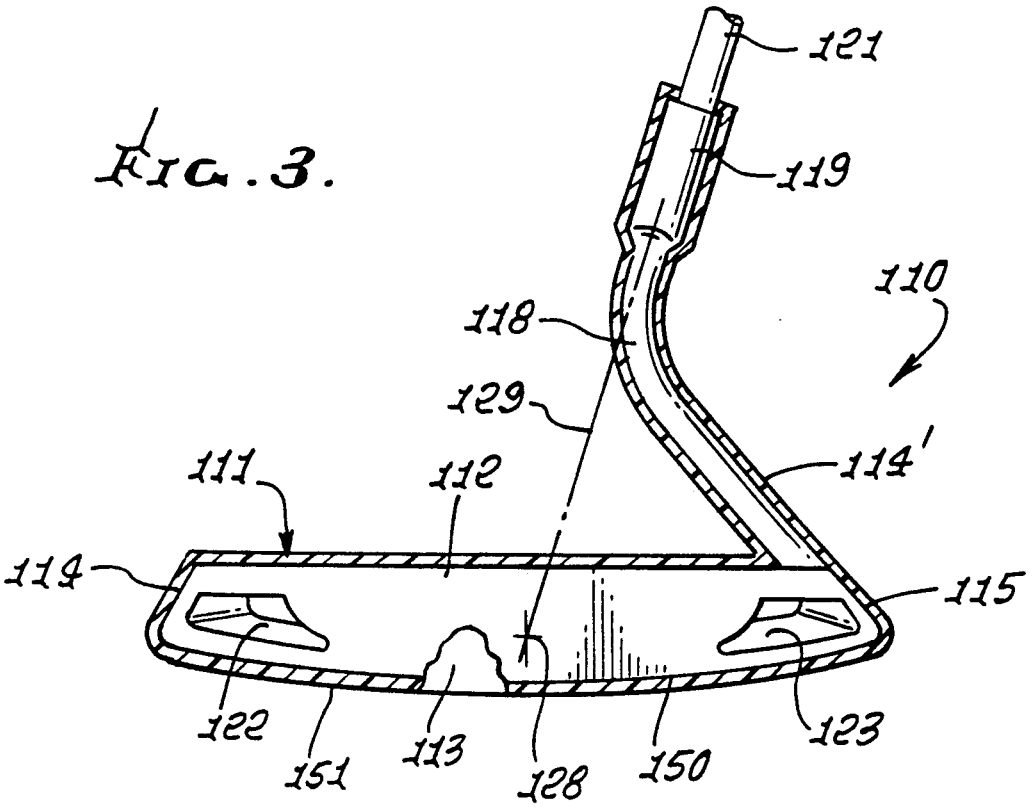
FIG. 3 is a view like FIG. 1 showing a modified head core with surfaces thereof covered by shell material molded about the core, and also about a hosel core integral with the head core.

Referring to FIGS. 1 and 2, the golf putter core 10 has a head 11 having a front face 12, to be covered by shell material, as referred to and as will be further seen in FIGS. 3–7. A portion of such material covering the front face is indicated at 13; and a portion of such material applied to the hosel appears at 14. See also shell material covering the toe and head areas at 13*a* in FIG. 2. The core defines an upright wall 12*a*, which forms the core front face 12, that wall extending from the toe 14 to the heel 15. A hosel 16 is integral with wall 12*a* at 17 and extends upwardly and toward the toe to a bend 18, from which the hosel extends upwardly and backwardly at 19. The latter is enlarged and forms a recess, 20 to receive a putter shaft 21, to be affixed to the hosel core portion 19. The axis of the shaft 21 and the hosel core portion 19 extends downwardly toward the middle point 28, just frontwardly of wall 12*a* and between the heel and toe, as referred to, i.e., at the "sweet spot" of the head. That axis is indicated at 29. See also FIG. 5, associated with FIGS. 3 and 4.

Weight means is located within the core 11, and typically proximate the toe and heel regions. As shown, recesses 22 and 23 are sunk in the front face in a rearward direction and extend through rearward head body portions 24 and 25 at the rear of wall 12*a*. Weights 26 and 27, of selected metal, are inserted into the recesses to be affixed in position, as by suitable bonding. One adhesive is epoxy material. Note that weight 26 is elongated directionally toward the toe and has progressively reduced vertical thickness at 26*a* to fit within the similarly shaped recess 23. Likewise, weight 27 is elongated toward the heel with progressively reduced thickness at 27*a*, to closely fit within the similarly shaped recess 22. Therefore, with the core weight of lightweight metal, such as aluminum for example, or aluminum alloys, or magnesium and alloys of same, and with the weights made of substantially heavier metal, the head is weighted at toe and heel, and characterized by substantial twist resistance during putting impact with a golf ball, as is desired. The weights intersecting the core front face serve to concentrate weight forwardly toward the plane containing the midpoint 28 and parallel to front face 12.

In this regard, the midpoint 28 is midway between the two inserts, which are similarly shaped, as referred to. The metal of the inserts may consist of, or be selected from, the group consisting of lead, brass, alloys of brass and lead, and tungsten. The midpoint 28 referred to also represents the center of gravity of the head 11.

To fit an individual golfer's need, a certain amount of moment of head inertia can be predetermined by selection of the weights inserted prior to molding of a shell about the core. Computation of the moment of inertia of the putter is as follows:

The aluminum alloy frame of the putter $$\text{total weight} \times [\text{arm of the rotation}] = 139 \text{ grams} \times (3.1 \text{ cm})^2 = 1335.79 \text{ g-cm}^2.$$

The lead inserts only:

volume × density × [arm of rotation] 16.5 $cm^3 \times 11.3 \times (4.1)^2 = 3134$ g-$cm^2$.

The tungsten inserts only:

16.5 cm × 19.3 × $(4.1)^2 = 5353$ g-$cm^2$.

Total moment of inertia of the new putter:

a. with lead inserts = 4470 g-$cm^2$ b. with tungsten inserts = 6688.9 g-$cm^2$.

Completion of the putter construction is carried out by placing the core with inserts therein into a mold, and then molding a thin shell of non-metallic material completely about the head 11, and also preferably about the hosel core described above. Such material may consist of a non-metallic, synthetic, resinous, bulk molding compound (that material being known), the molding being by the hot compression method; or the shell material can be injected into the mold about the shell and inserts. In the latter event, the shell may consist essentially of ABS plastic material containing filler consisting of 13% to 15% in weight of carbon fibers, 5 to 6 mm in length. Instead of ABS, one may use polycarbonate, or polypropylene, or combinations thereof. The shell thickness is desirably between about 1.0 and 2.0 mm; the optimum thickness being 1.5±0.5 mm. Such material provides a lifetime gloss of the putter surface, the appearance of which is uniform over the entire putter head and hosel, providing minimum distraction to the golfer during putting. The sole of the core appears at 50; and the sole of the shell over the core appears at 51.

FIGS. 3–7 show another very similar putter with the same numbers applied as are used in FIGS. 1 and 2, but with a "1" in front of each number. Also, the plastic shell is shown about putter elements.

In FIGS. 1 and 2, a depression is formed between the body portions 24 and 25 immediately above a rearward extending bottom wall having sections 35, 36 and 37, rearwardly of the lowermost extent of front wall 12*a*. A carrier 38 is integral with the sections 35–37 to extend upwardly within the depression 39, as referred to. That carrier forms three circular cross section openings—40, 41, and 42—which extend in a forward direction toward the front wall. Additional small weights may be received into the recesses 40, 41 and 42 as selectively desired, to provide more weighting toward the heel or more weighting toward the toe. Note that the recesses 40–42 are substantially smaller than the recesses 22 and 23, and open rearwardly.

Figure 4:
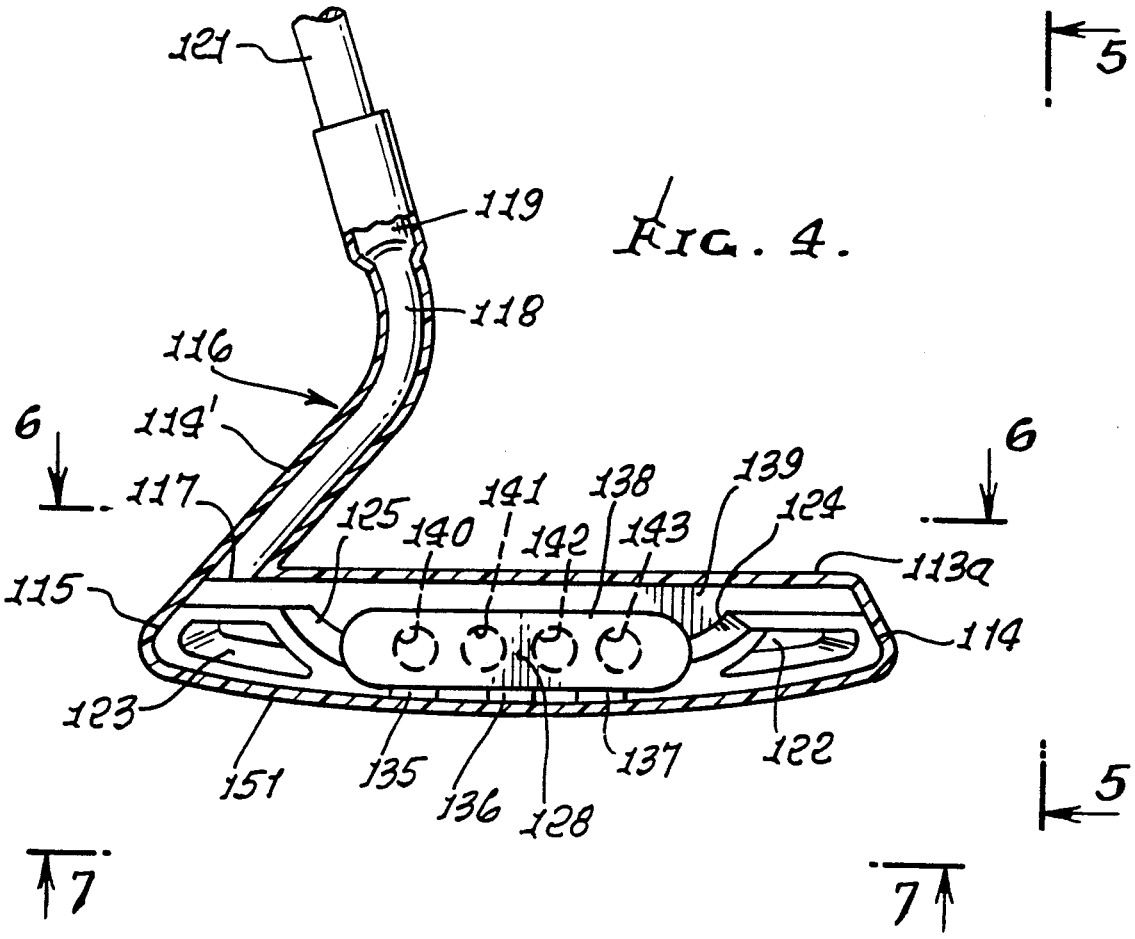
FIG. 4 is an elevation showing the rear side of the FIG. 3 putter head and hosel.

Similarly, in FIG. 4, a carrier 138 is elongated in the cavity 139, between the body portions 125 and 124, the carrier mounted on the body wall sections 135, 136 and 137 as before. Four smaller recesses 140–143 are provided in the carrier in spaced relation lengthwise of the head core between the toe and heel; and selected weights may be inserted forwardly into such smaller recesses from rearwardly open ends thereof, to enhance weighting toward the heel and toward the toe, or to increase balance weighting at opposite sides of the midpoint 128. Note that recesses 141 and 142 are equally spaced at opposite sides of the midpoint, as are recesses 140 and 143.

In FIG. 2, recess 41 is exactly in alignment with midpoint 28. The shell material may be molded over the carriers 38 and 138 and the weights therein.

Advantageous properties are as follows:

1. The putter is constructed and manufactured such that its moment of inertia is higher than that of any other putter of comparable size and weight. The exact value of moment of inertia of a putter is measured by a torsional balance.

2. The putter is statically and dynamica balanced, has a light alloy frame, balance weights, and an outer plastic shell. The putter can oscillate freely as a pendulum, if held freely at any point of the shaft.

3. The shell material provides a lightweight, protective cover for the metallic core and is extremely resistant to cuts or nicks, as well as providing a uniform look to the putter head and hosel.

I claim:

1. In a golf putter head having a toe and heel and a ball striking face, the combination comprising:

a) a metallic core generally in the shape of said head but contained within said head, the core having toe and heel portions, b) weight means located within said core proximate said toe and heel portions, c) and a relatively thin, non-metallic shell molded about the entirety of said core and said weight means, d) said weight means comprising inserts received in recesses formed in said core toe and heel portions and concealed by said shell, e) the head having a front wall and a depression between said recesses, and including a carrier on the head in said depression, there being selected additional weights in said carrier, said shell also molded about said carrier and said additional weights, f) said shell having a thickness between about 1 and 2 millimeters, and said shell embedding the inserts and weights in the core and carrier.

2. The combination of claim 1 wherein said core has a front face and said recesses are sunk in said front face, said shell molded over said front face forwardly of the carrier and over said recesses to define said ball-striking face.

3. The combination of claim 2 wherein each of said recesses is elongated in a heel-to-toe direction.

4. The combination of claim 2 wherein said hosel defines an axis which extends downwardly toward a midpoint between said recesses.

5. The combination of claim 1 wherein said shell consists essentially of bulk molding compound.

6. The combination of claim 5 wherein said shell has a thickness between about 1.0 and 2.0 millimeters.

7. The combination of claim 1 wherein said shell consists of material selected from the group consisting of:

a) ABS plastic material containing filler consisting of carbon fibers, 5 to 6 mm in length b) polycarbonate c) polypropylene.

8. The combination of claim 7 wherein said shell has a thickness between about 1.0 and 2.0 millimeters.

9. The combination of claim 7 wherein said core consists essentially of aluminum.

10. The combination of claim 9 wherein said inserts consist of material selected from the group consisting of a) lead b) brass c) alloys of brass and lead d) tungsten.

11. The combination of claim 1 wherein said shell has thickness between about 1.0 and 2.0 millimeters.

12. The combination of claim 1 including a hosel core connected with said head core, said shell also molded about at least part of the hosel core above the level of the head.

13. The combination of claim 12 wherein said shell is molded over substantially the entirety of said head core and hosel core.

* * * * *